US009715972B2

(12) United States Patent
Kline et al.

(10) Patent No.: US 9,715,972 B2
(45) Date of Patent: Jul. 25, 2017

(54) ELECTRICAL SWITCHING APPARATUS AND TRIP ASSEMBLY THEREFOR

(71) Applicant: Eaton Corporation, Cleveland, OH (US)

(72) Inventors: Kameron James Kline, Pittsburgh, PA (US); Mark Janusek, Bethel Park, PA (US); Jack Edward Devine, Pittsburgh, PA (US); David Turner, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/364,854

(22) Filed: Nov. 30, 2016

(65) Prior Publication Data

US 2017/0084403 A1 Mar. 23, 2017

Related U.S. Application Data

(63) Continuation of application No. 15/154,001, filed on May 13, 2016, now Pat. No. 9,595,403, which is a (Continued)

(51) Int. Cl.
*H01H 73/12* (2006.01)
*H01H 3/42* (2006.01)

(Continued)

(52) U.S. Cl.
CPC ..... *H01H 3/42* (2013.01); *H01H 3/38* (2013.01); *H01H 3/46* (2013.01); *H01H 9/161* (2013.01);

(Continued)

(58) Field of Classification Search
CPC ..... H01H 71/2463; H01H 71/322; H01H 73/12–73/14; H01H 73/36–73/38; H01H 73/50; H01H 73/64; H01H 73/66
See application file for complete search history.

(56) References Cited

U.S. PATENT DOCUMENTS 4,912,439 A 3/1990 Nagy et al.
4,939,490 A 7/1990 Bernier et al.

(Continued)

FOREIGN PATENT DOCUMENTS

EP 1 098 344 A2 5/2001
EP 1 643 527 A2 4/2006

OTHER PUBLICATIONS

Notice of Allowance, Corresponding U.S. Appl. No. 15/154,001, filed May 13, 2016.

(Continued)

*Primary Examiner* — Ramon M Barrera
(74) *Attorney, Agent, or Firm* — Eckert Seamans; John Powers; Grant Coffield

(57) ABSTRACT

A trip assembly is for an electrical switching apparatus. The electrical switching apparatus includes a housing, an electrical communication assembly coupled to the housing, separable contacts enclosed by the housing, and an operating mechanism for opening and closing the separable contacts. The trip assembly has an indication assembly including a plunger member and a number of auxiliary switches each structured to be coupled to the housing. The plunger member is structured to actuate each of the number of auxiliary switches, thereby electrically communicating a circuit status to the electrical communication assembly.

16 Claims, 9 Drawing Sheets

Related U.S. Application Data continuation of application No. 14/706,061, filed on May 7, 2015, now Pat. No. 9,384,910.

(51) Int. Cl.

| | |
|---|---|
| ***H01H 3/38*** | (2006.01) |
| ***H01H 3/46*** | (2006.01) |
| ***H01H 9/16*** | (2006.01) |
| ***H01H 71/04*** | (2006.01) |
| ***H01H 71/24*** | (2006.01) |
| ***H01H 73/36*** | (2006.01) |
| ***H01H 73/38*** | (2006.01) |
| ***H01H 73/64*** | (2006.01) |

(52) U.S. Cl.

CPC ..... *H01H 71/04* (2013.01); *H01H 71/24* (2013.01); *H01H 71/2463* (2013.01); *H01H 73/12* (2013.01); *H01H 73/36* (2013.01); *H01H 73/38* (2013.01); *H01H 73/64* (2013.01); *H01H 2235/01* (2013.01)

(56) References Cited

U.S. PATENT DOCUMENTS

| | | | | |
|---|---|---|---|---|
| 5,886,641 | A | 3/1999 | Ulerich et al. | |
| 5,907,461 | A | 5/1999 | Hartzel et al. | |
| 5,927,484 | A | 7/1999 | Malingowski et al. | |
| 6,201,460 | B1 | 3/2001 | Winslett et al. | |
| 6,433,290 | B1 * | 8/2002 | Ulerich ..... | H01H 71/04 200/308 |
| 8,686,815 | B2 | 4/2014 | Sohn | |

OTHER PUBLICATIONS

European Patent Office, "International Search Report and Written Opinion" PCT/US2016/030539, Jul. 15, 2016, 12 pp.

* cited by examiner

ELECTRICAL SWITCHING APPARATUS AND TRIP ASSEMBLY THEREFOR

CROSS-REFERENCE TO RELATED APPLICATION

This application is a continuation of, and claims priority under 35 U.S.C. §120 from, U.S. patent application Ser. No. 15/154,001, filed on May 13, 2016, and entitled "ELECTRICAL SWITCHING APPARATUS AND TRIP ASSEMBLY THEREFOR;" which is a continuation of U.S. patent application Ser. No. 14/706,061, filed May 7, 2015, now U.S. Pat. No. 9,384,910, the contents of which are incorporated herein by reference.

BACKGROUND

Field

The disclosed concept pertains generally to electrical switching apparatus, such as, for example, circuit breakers. The disclosed concept also pertains to trip assemblies for electrical switching apparatus.

Background Information

Electrical switching apparatus are used to protect electrical circuitry from damage due to a trip condition, such as, for example, an overcurrent condition, an overload condition, an undervoltage condition, a relatively high level short circuit or fault condition, a ground fault or arc fault condition. Molded case circuit breakers, for example, include at least one pair of separable contacts which are operated either manually by way of a handle disposed on the outside of the case, or automatically by way of a trip unit in response to the trip condition.

Known trip units take up significant space within the circuit breaker. As a result of the lack of available space, it is difficult to determine whether the separable contacts are open or closed. That is, little or no space is available for a readily visible trip indicator or status indicator for quickly and easily determining the breaker status.

There is, therefore, room for improvement in electrical switching apparatus and in trip assemblies therefor.

SUMMARY

These needs and others are met by embodiments of the disclosed concept, which are directed to an improved electrical switching apparatus and trip assembly therefor.

In accordance with one aspect of the disclosed concept, a trip assembly is provided for an electrical switching apparatus. The electrical switching apparatus includes a housing, an electrical communication assembly coupled to the housing, separable contacts enclosed by the housing, and an operating mechanism for opening and closing the separable contacts. The trip assembly has an indication assembly including a plunger member and a number of auxiliary switches each structured to be coupled to the housing. The plunger member is structured to actuate each of the number of auxiliary switches, thereby electrically communicating a circuit status to the electrical communication assembly.

In accordance with another aspect of the disclosed concept, an electrical switching apparatus including a housing, an electrical communication assembly coupled to the housing, separable contacts enclosed by the housing, an operating mechanism for opening and closing the separable contacts, and the aforementioned trip assembly is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
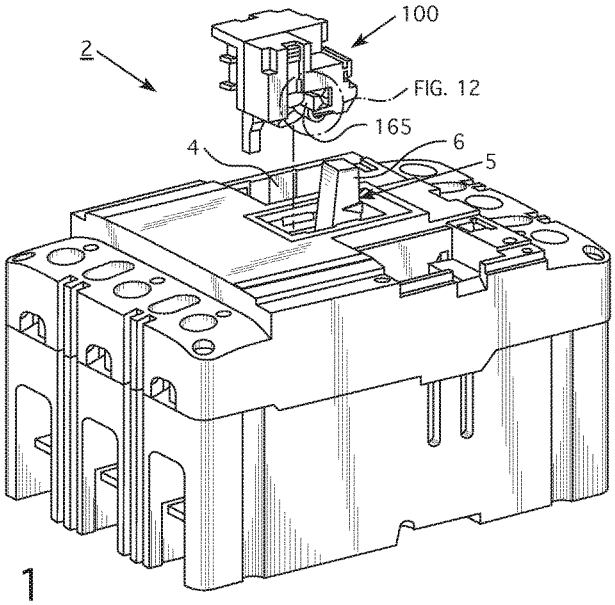
FIG. 1 is a partially exploded isometric view of an electrical switching apparatus and trip assembly therefor, in accordance with a non-limiting embodiment of the disclosed concept.
Figure 2:
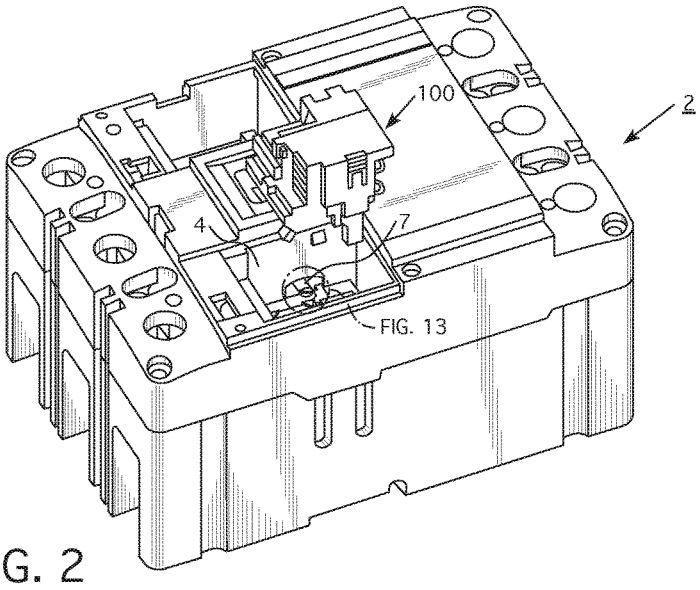
FIG. 2 is another partially exploded isometric view of the electrical switching apparatus and trip assembly therefor of FIG. 1.
Figure 3:
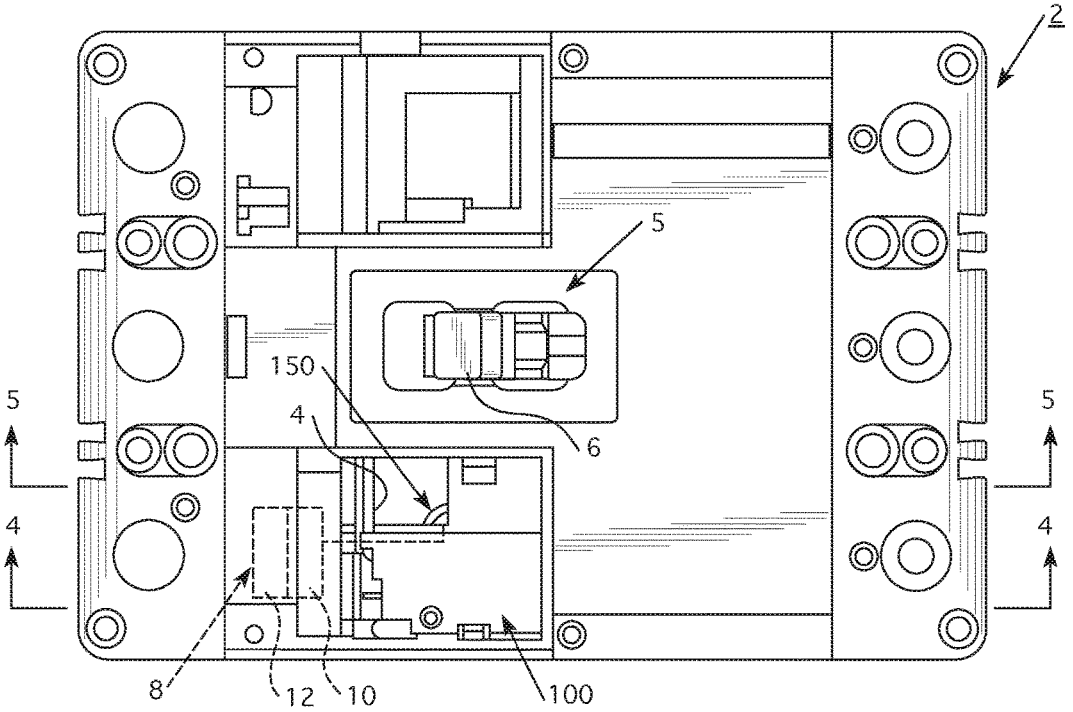
FIG. 3 is an assembled top plan view of the electrical switching apparatus and trip assembly therefor of FIG. 1.

For purposes of the description hereinafter, directional phrases used herein such as, for example, "clockwise", "counterclockwise", "up", "down", and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 4:
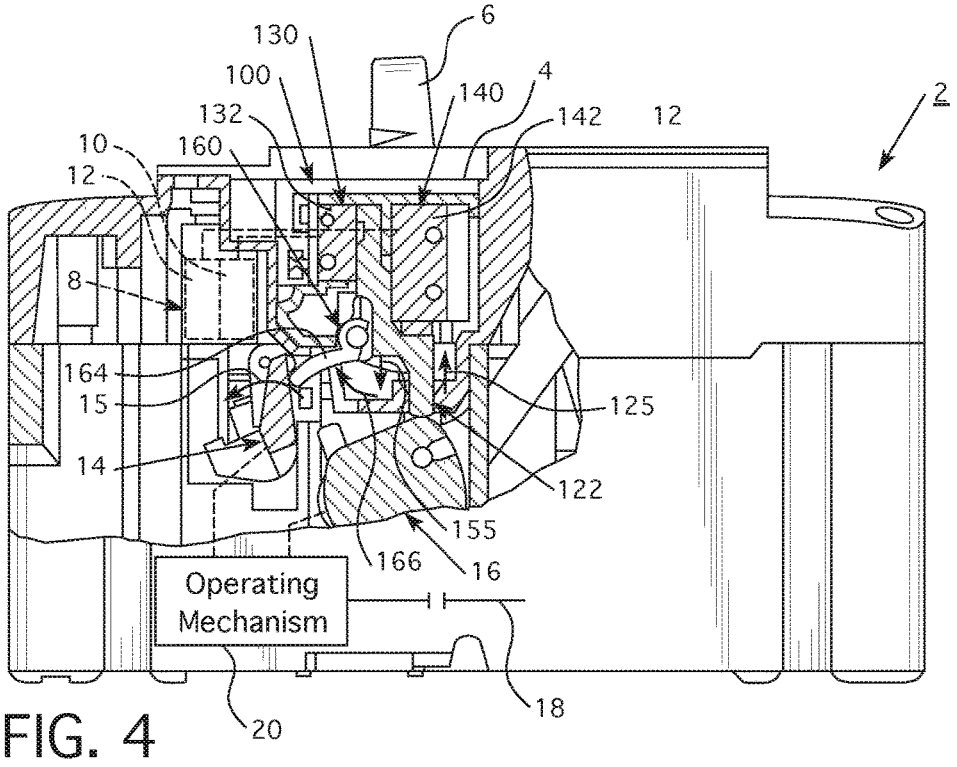
FIG. 4 is a side elevation partially in section view of the electrical switching apparatus and trip assembly therefor, taken along line 4-4 of FIG. 3, and shown with a portion of the electrical switching apparatus cut away to show internal structures.
Figure 5:
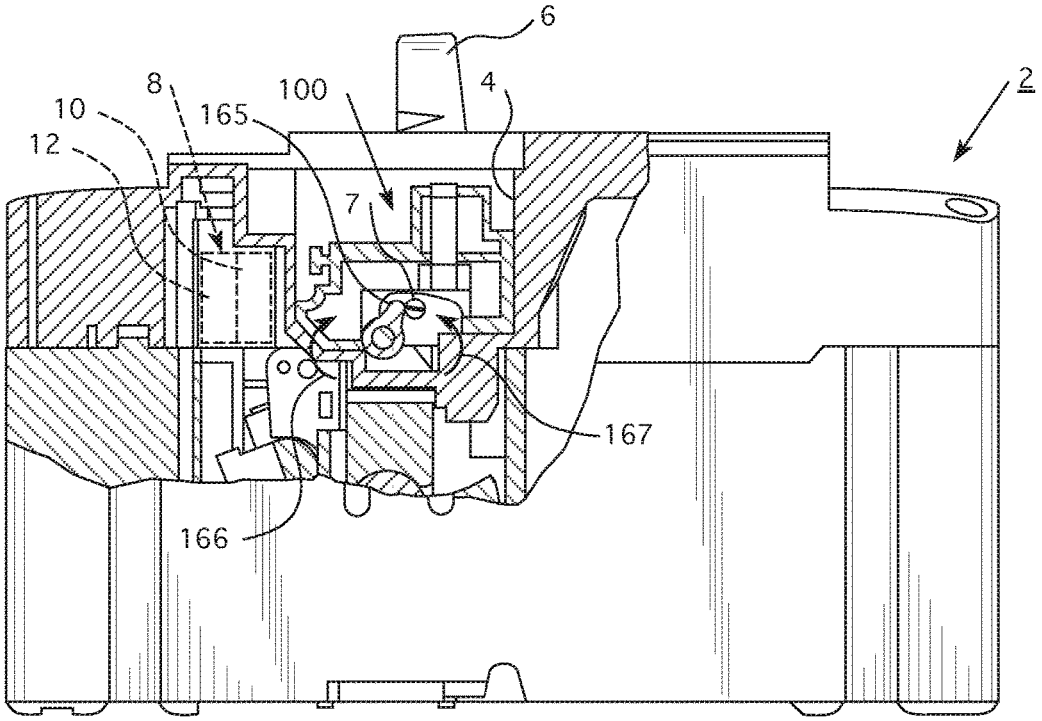
FIG. 5 is a side elevation partially in section view of the electrical switching apparatus and trip assembly therefor, taken along line 5-5 of FIG. 3, and shown with a portion of the electrical switching apparatus cut away to show internal structures

FIGS. 1 through 5 show an electrical switching apparatus (e.g., without limitation, molded case circuit breaker 2) in accordance with a non-limiting embodiment of the disclosed concept. The example circuit breaker 2 includes a housing 4, a reset assembly 5, an electrical communication assembly 8 (shown in simplified form in FIGS. 3 through 5), a pair of separable contacts 18 (shown in simplified form in FIG. 4) enclosed by the housing 4, and an operating mechanism 20 (shown in simplified form in FIG. 4) for opening and closing the separable contacts 18. The reset assembly 5 and the electrical communication assembly 8 are coupled to the housing 4. The operating mechanism 20 includes a trip bar 14 (FIG. 4) and a crossbar 16 (FIG. 4). As will be discussed in greater detail below, the circuit breaker 2 further includes a trip assembly 100 that advantageously operates to trip the separable contacts 18, while simultaneously electrically communicating a circuit status to the electrical communication assembly 8. In this manner, existing space within the circuit breaker 2 is utilized by the single subassembly (i.e., the trip assembly 100) not only to trip the separable contacts 18, but also to electrically communicate the circuit status to the electrical communication assembly 8, thereby allowing operators to know whether the separable contacts 18 are open or closed.

Figure 6:
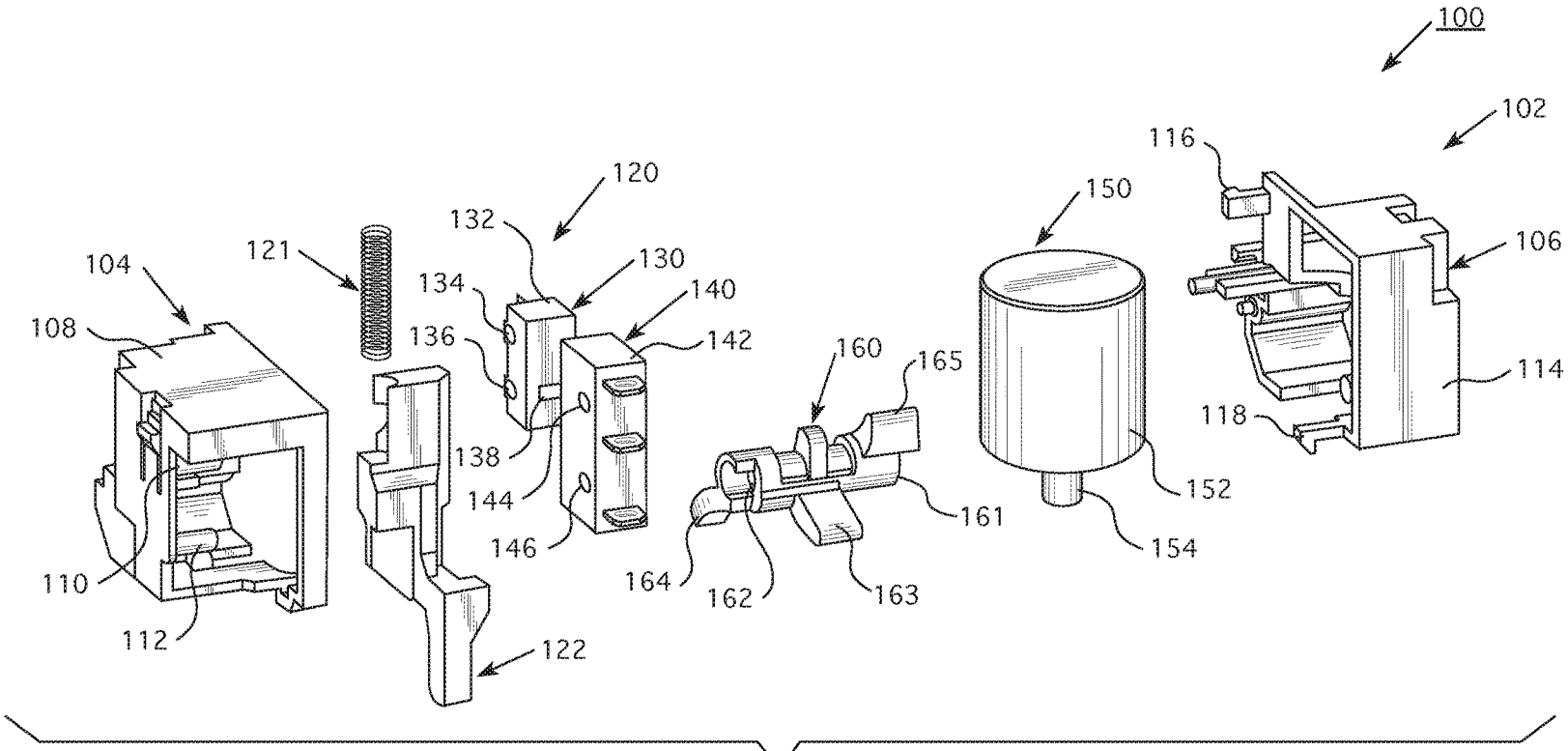
FIGS. 6 and 7 are exploded isometric views of the trip assembly for the electrical switching apparatus of FIG. 1.
Figure 7:
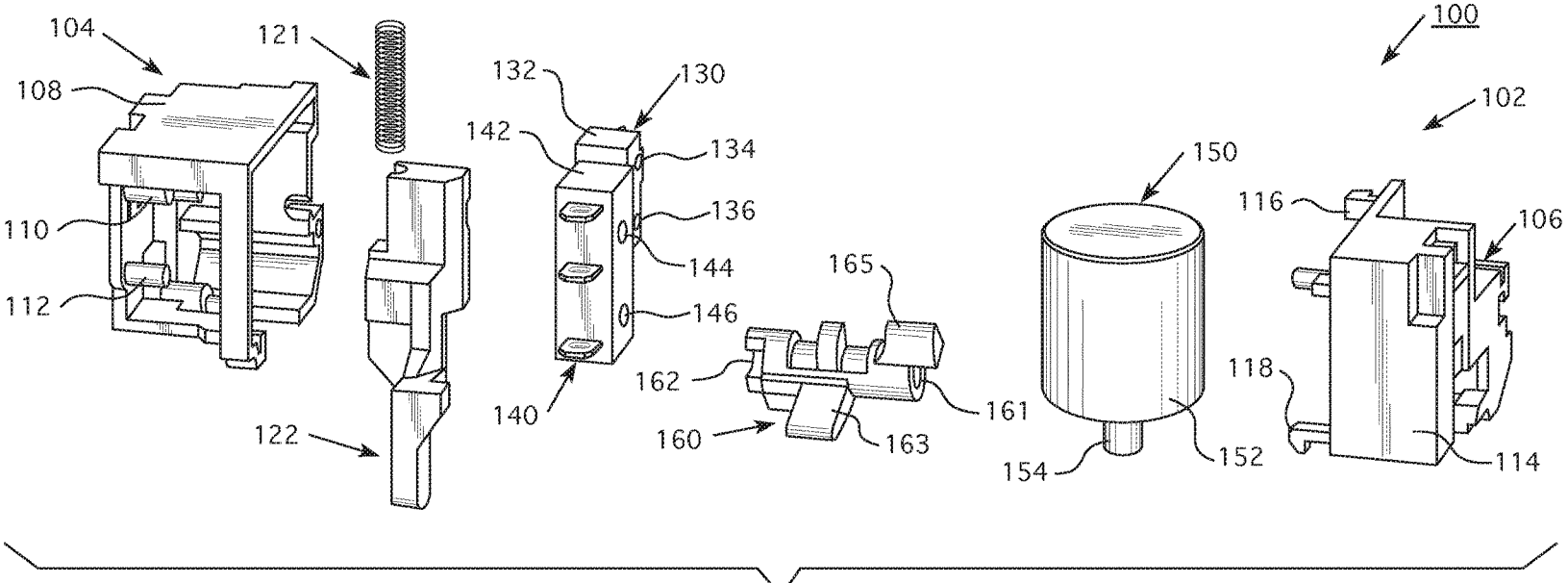

FIGS. 6 and 7 show exploded views of the trip assembly 100. As shown, the trip assembly 100 preferably includes a mounting assembly 102, an indication assembly 120, an actuating element (e.g., without limitation, solenoid 150), and a trip cam 160. The indication assembly 120, the solenoid 150, and the trip cam 160 are each coupled to the mounting assembly 102. The indication assembly 120 includes a biasing element (e.g., without limitation, spring 121), a plunger member 122 and a number of auxiliary switches 130,140. The plunger member 122 partially extends into the mounting assembly 102. Each of the auxiliary switches 130,140 includes a respective body portion 132,142 and a respective number of holes (see, for example, two holes 134,136 for the body portion 132, and two holes 144,146 for the body portion 142). Each of the auxiliary switches 130,140 further includes a respective deflection member (see, for example, deflection member 138 (FIG. 6) located on the body portion 132). In operation, the plunger member 122 is structured to move between each of the auxiliary switches 130,140 in order to actuate each of the auxiliary switches 130,140, thereby causing each of the respective deflection members 138 (and the respective deflection member of the auxiliary switch 140, not shown) to move inwardly with respect to the respective body portion 132,142. In this manner, and as will be discussed below, responsive to the plunger member 122 moving between each of the auxiliary switches 130,140, each of the auxiliary switches advantageously sends a signal to the electrical communication assembly 8 (FIGS. 3-5) to electrically communicate the circuit status.

The mounting assembly 102 includes a number of mounting members (see, for example, two mounting members 104,106) that contain the indication assembly 120, the solenoid 150, and the trip cam 160. The mounting members 104,106 are each coupled to the housing 4 of the circuit breaker 2. The mounting member 104 includes a body 108 and a number of protrusions (see, for example, two protrusions 110,112) extending from the body 108. In operation, each of the protrusions 110,112 extends into a corresponding one of the holes 144,146 of the auxiliary switch 140 in order to couple the auxiliary switch 140 to the mounting member 104 of the mounting assembly 102. Similarly, the mounting member 104 further includes another number of protrusions (not shown) that extend into the holes 134,136 in order to couple the auxiliary switch 130 to the mounting member 104.

Continuing to refer to FIGS. 6 and 7, the mounting member 106 includes a body 114 and a number of protrusions (see, for example, two protrusions 116,118) extending from the body 114. It will be appreciated that the protrusions 116,118 extend into the mounting member 104 in order to couple the mounting members 104,106 to each other, for example, by a snap-fit mechanism, without the need to employ separate fastening members. In this manner, the mounting members 104,106 advantageously operate to hold and contain the spring 121, the plunger member 122, the auxiliary switches 130,140, the solenoid 150, and the trip cam 160.

The solenoid 150 includes a body 152 and an extension member 154 extending from the body 152. The trip cam 160 includes a number of recessed retaining portions 161,162, a transfer leg 163, a driving leg 164 and a reset leg 165. The trip cam 160 is preferably made of a single piece of material (e.g., without limitation, an injection molded piece), thereby simplifying manufacturing and reducing cost. Additionally, each of the transfer leg 163, the driving leg 164 and the reset leg 165 extends away from each of the retaining portions 161,162.

Figure 8:
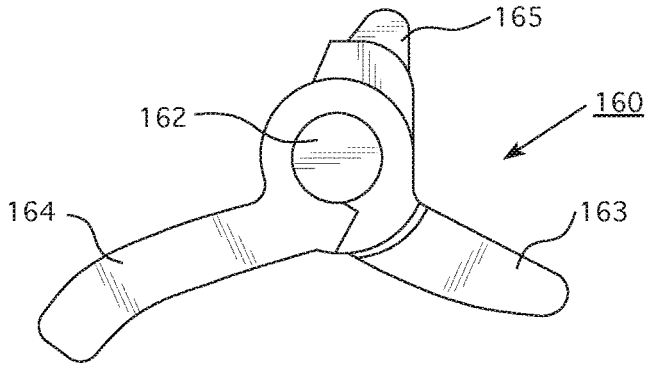
FIG. 8 is a front elevation view of the trip cam for the trip assembly.
Figure 9:
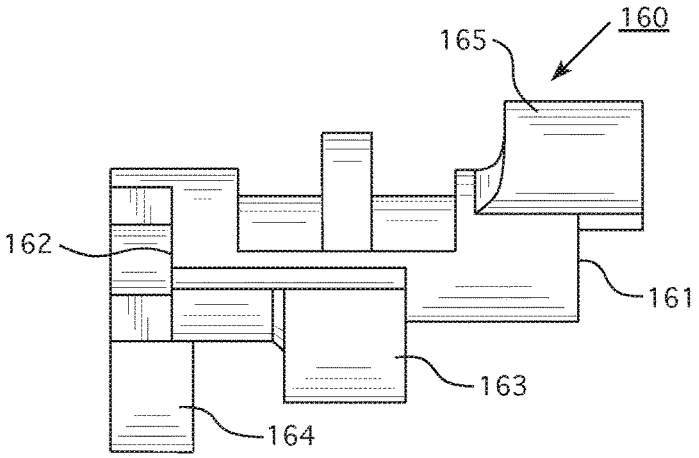
FIG. 9 is a side elevation view of the trip cam of FIG. 8.

FIGS. 8 and 9 show different views of the trip cam 160. As shown in FIG. 9, the retaining portion 161 is located opposite and distal from the retaining portion 162. The driving leg 164 is located opposite and distal from the reset leg 165. The driving leg 164 extends from the retaining portion 162. The reset leg 165 extends from the retaining portion 161. The transfer leg 163 is located between and is spaced from the driving leg 164 and the reset leg 165. The transfer leg 163 is located between and is spaced from each of the retaining portions 161,162.

Figure 10:
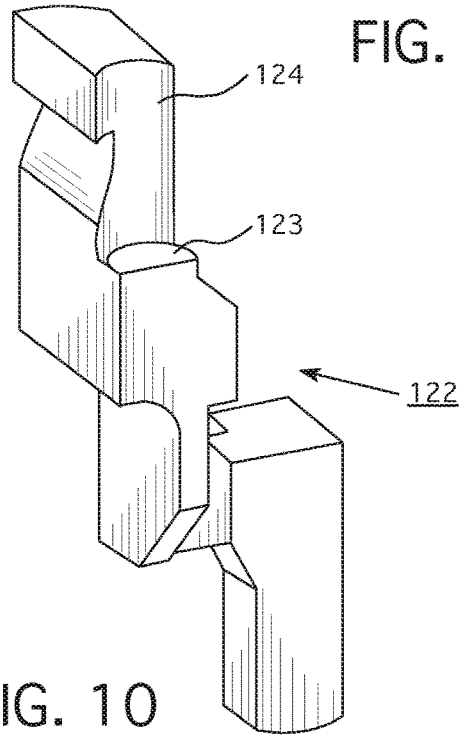
FIG. 10 is an isometric view of the plunger member for the trip assembly.

FIG. 10 shows an isometric view of the plunger member 122. As shown, the plunger member 122 includes a planar portion 123 and a cylindrical-shaped receiving portion 124 located adjacent and perpendicular to the planar portion 123. It will be appreciated that the spring 121 (FIGS. 6 and 7) engages the planar portion 123 and is located in the receiving portion 124. It will further be appreciated that the spring 121 engages the mounting member 104 in order to bias the plunger member 122 away from the auxiliary switches 130,140 and toward engagement with the crossbar 16, as will be discussed below.

Figure 11:
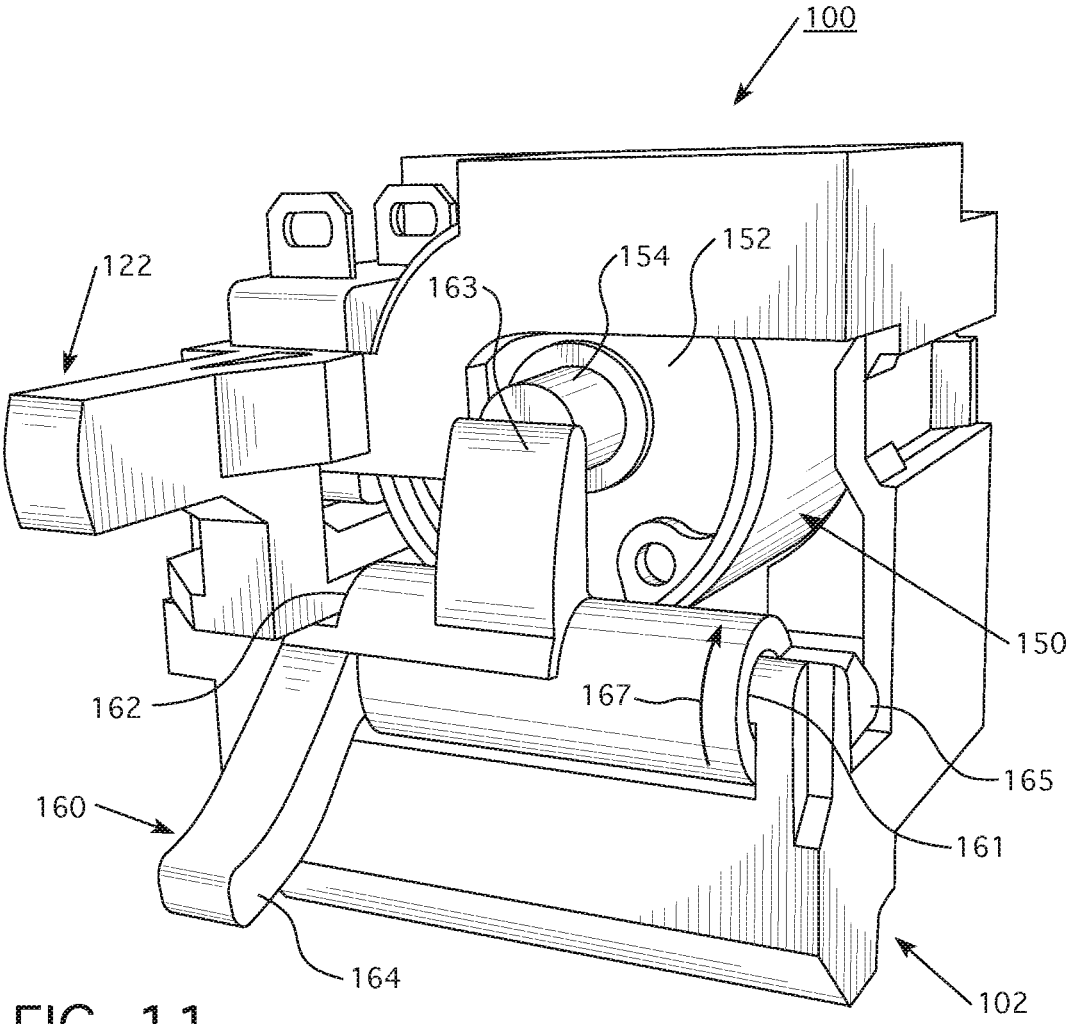
FIG. 11 is an assembled rear isometric view of the trip assembly.

FIG. 11 shows an assembled view of the trip assembly 100. As shown, each of the retaining portions 161,162 is pivotably coupled to the mounting assembly 102, thus allowing the trip cam 160 to rotate independently with respect to the mounting assembly 102. Furthermore, the extension member 154 is aligned with (i.e., structured to engage and thereby drive) the transfer leg 163 of the trip cam 160. Responsive to a trip condition (e.g., without limitation, an overload condition), a main printed circuit board 10 (shown in simplified form in FIGS. 3 through 5) sends an electrical signal to the solenoid 150, which causes the extension member 154 to rapidly move away from the body 152. As a result, the extension member 154 of the solenoid 150 drives the transfer leg 163 of the trip cam 160, thus causing the trip cam 160 to rotate. Similarly, because the retaining portions 161,162 are pivotably coupled to the mounting assembly 102, when extension member 154 drives the transfer leg 163, each of the driving leg 164 and the reset leg 165 likewise rotates together with the transfer leg 163.

Referring again to FIG. 4, in operation, when the trip cam 160 rotates in response to a trip condition, the driving leg 164 advantageously causes the separable contacts 18 to trip open and the auxiliary switches 130,140 to electrically communicate the circuit status to the electrical communication assembly 8. More precisely, when the trip cam 160 rotates in a first direction 166 in response to a trip condition, the driving leg 164 engages and drives the trip bar 14 in a second direction 15 opposite the first direction 166. In the depicted orientation of FIG. 4, the first direction 166 is clockwise, and the second direction 15 is counterclockwise. In other words, the solenoid 150 drives the trip cam 160 into the trip bar 14 in order to trip open the separable contacts 18.

At the same time as the operating mechanism 20 trips open the separable contacts 18 (i.e., simultaneously), the operating mechanism 20 drives the plunger member 122 between the auxiliary switches 130,140. More specifically, when the trip bar 14 rotates in the direction 15, the crossbar 16 drives the plunger member 122 in a direction 125 between the auxiliary switches 130,140. As stated above, the spring 121 (FIGS. 6 and 7) biases the plunger member 122 away from the auxiliary switches 130,140 and toward engagement with the crossbar 16. The force of the spring 121 on the plunger member 122 is relatively strong in order that when the circuit breaker 2 moves from the OFF position to the ON position, the plunger member 122 advantageously does not get stuck. Thus, the spring 121 exerts a force on the plunger member 122 in a first direction 155, which in the depicted orientation of FIG. 4, is down. Before a trip condition (i.e., when the separable contacts 18 are closed and the circuit breaker 2 is in an ON position), the spring 121, which is fixed at one end by the mounting member 104, forces the plunger member 122 into a position in which it allows the deflection members 138 (FIGS. 6 and 7) (and the deflection member of the auxiliary switch 140 (not shown)) to be fully extended outwardly with respect to the respective body portions 132,142.

Continuing to refer to FIG. 4, the solenoid 150 (not shown in FIG. 4) cooperates with the indication assembly 120 in order to electrically communicate the circuit status to the electrical communication assembly 8. It will be appreciated that when the solenoid 150 (not shown in FIG. 4) moves in the first direction 155, the plunger member 122 moves in the second direction 125 opposite the direction 155 in order to electrically communicate the circuit status to the electrical communication assembly 8. In the depicted orientation of FIG. 4, the second direction 125 is up. When the separable contacts 18 trip open, the crossbar 16 rotates in the direction 15, thereby exerting a force on and moving the plunger member 122 in the direction 125. When the plunger member 122 moves in the direction 125, the plunger member 122 causes (i.e., engages, drives, deflects) each of the deflection members 138 (FIGS. 6 and 7) (and the deflection member of the auxiliary switch 140 (not shown)) to deflect inwardly with respect to the respective body portion 132,142.

Additionally, the electrical communication assembly 8 includes the main printed board 10 and a customer interface 12 (shown in simplified form) each coupled to the housing 4. The customer interface 12 is an external control module (e.g., without limitation, a control light), for customer monitoring of the circuit breaker 2. The auxiliary switch 130 and the solenoid 150 are each electrically connected to the main printed circuit board 10. The auxiliary switch 140 is electrically connected to the customer interface 12. When the deflection member 138 (FIGS. 6 and 7) deflects inwardly with respect to the respective body portion 132, the auxiliary switch 130 sends an electrical signal to the main printed circuit board 10, thereby electrically communicating the circuit status to the main printed circuit board 10. Similarly, when the deflection member (not shown) of the auxiliary switch 140 deflects inwardly with respect to the body portion 142, the auxiliary switch 140 sends an electrical signal to the customer interface 12, thereby electrically communicating the circuit status to the customer interface 12.

Thus, the trip assembly 100 advantageously operates to trip the separable contacts 18, while simultaneously electrically communicating the circuit status to the main printed circuit board 10 and the customer interface 12. Stated differently, the trip assembly 100 is a multifunctional subassembly 100 that trips the separable contacts 18 and electrically communicates the circuit status. In this manner, operators do not need to disassemble components of the circuit breaker 2 in order to determine whether the separable contacts 18 are open or closed. This improves safety in situations where typical mechanisms for determining circuit status, such as the operating handle 6 position, fail to provide accurate indications of circuit status. Additionally, existing space within the circuit breaker 2 is advantageously utilized to accommodate the trip assembly 100, thereby reducing cost. Furthermore, as this is an electronic trip unit, the resulting instantaneous tripping advantageously provides more protection of the circuit.

Figure 12:
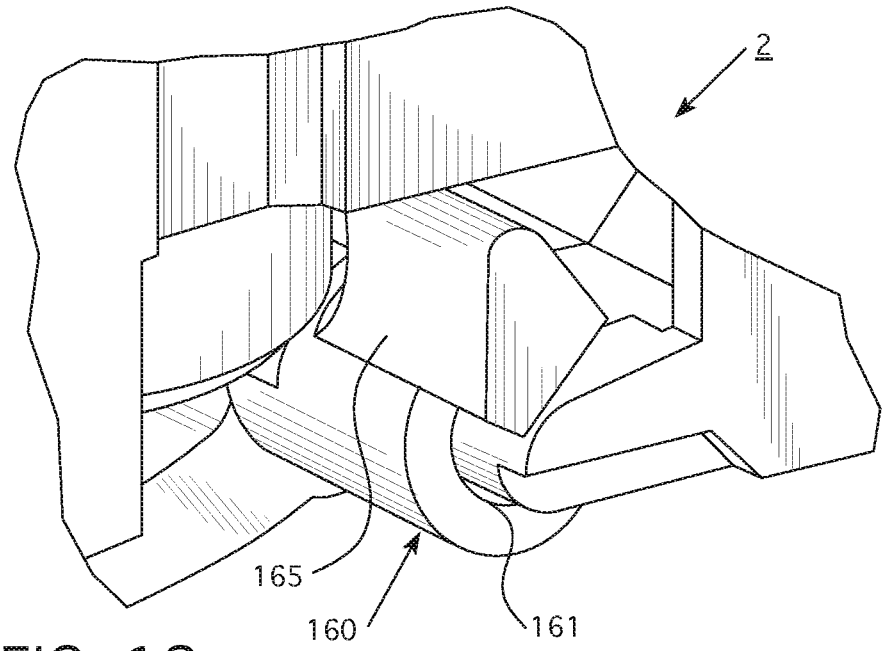
FIG. 12 is an enlarged view of a portion of the electrical switching apparatus and trip assembly therefor of FIG. 1.
Figure 13:
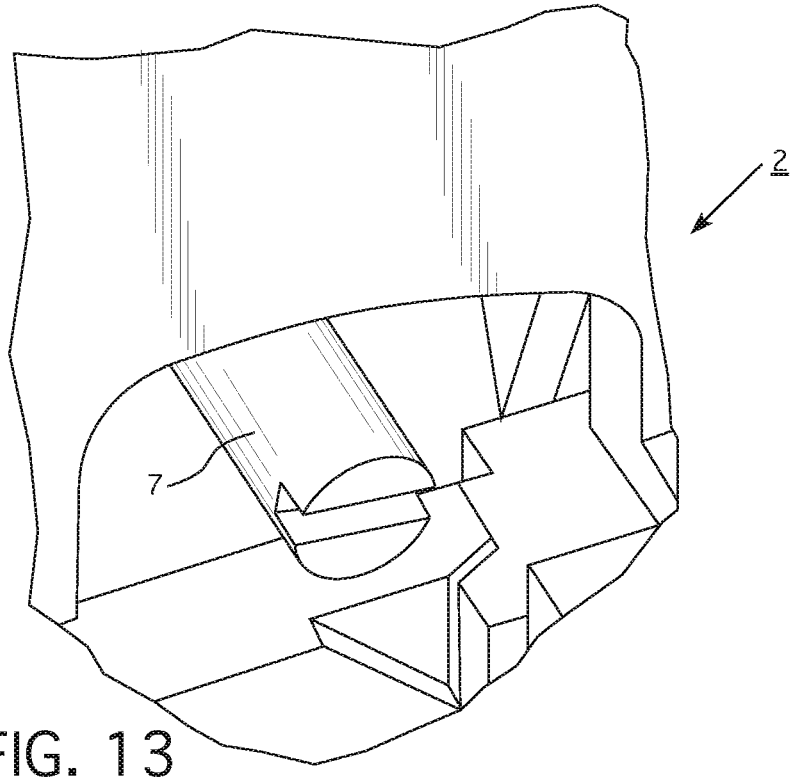
FIG. 13 is an enlarged view of a portion of the electrical switching apparatus and trip assembly therefor of FIG. 2.

In order to reset the circuit breaker 2, the circuit breaker 2 further includes the reset assembly 5 coupled to the housing 4. The reset assembly 5 includes an operating handle 6 (FIGS. 1 and 3-5) and a reset pin 7 (FIGS. 2, 5 and 13) coupled to the operating handle 6. The operating handle 6 extends into the housing 4. FIGS. 12 and 13 show enlarged views of portions of FIGS. 1 and 2, respectively. It will be appreciated that the reset pin 7 (FIGS. 2, 5 and 13) terminates proximate and is structured to drive the reset leg 165 (FIGS. 1, 5-9 and 11-12). More specifically, and with reference to FIG. 5, movement of the operating handle 6 (such as, for example, when an operator manually closes the separable contacts 18 (FIG. 4)) causes the reset pin 7 to rotate the reset leg 165 in a direction 167. In the depicted orientation, the direction 167 is counterclockwise, and is opposite the direction 166. Referring to FIG. 11, when the reset leg 165 rotates in the direction 167, the transfer leg 163 drives the extension member 154 of the solenoid 150 inwardly with respect to the body 152, thereby resetting the solenoid 150. Thus, the reset assembly 5 cooperates with the trip cam 160 in order to reset the solenoid 150.

Figure 14:
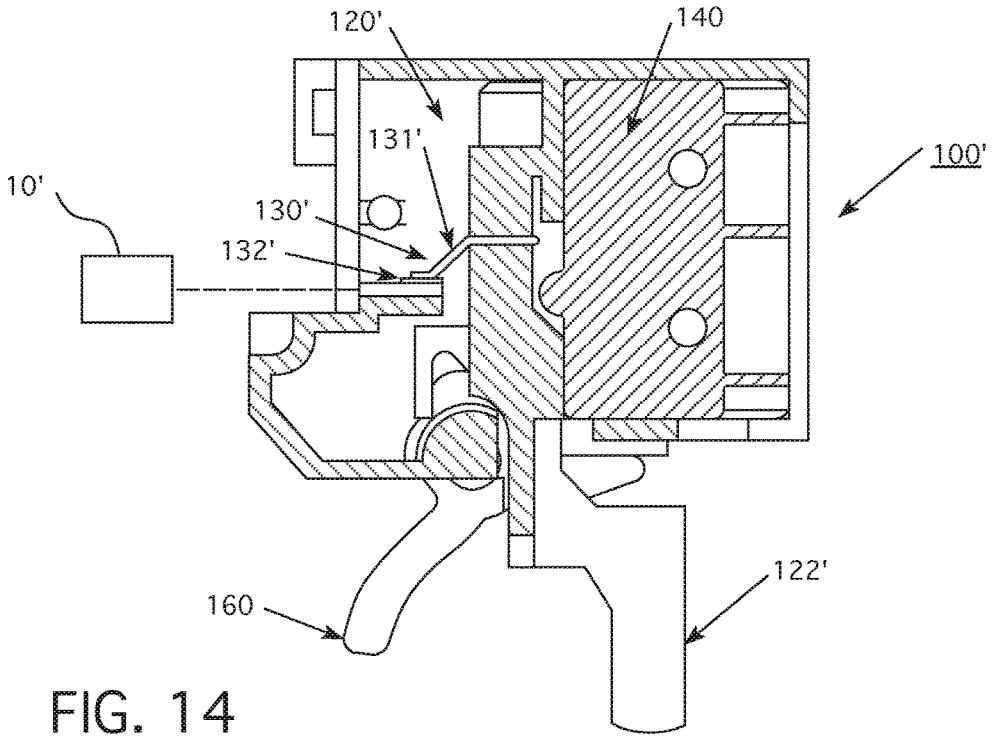
FIG. 14 is a section view of a trip assembly, shown with a main printed circuit board in simplified form, and with contact strips engaging, in accordance with another non-limiting embodiment of the disclosed concept.

Furthermore, the disclosed concept is not limited to the auxiliary switches 130,140 sending the desired signals to the electrical communication assembly 8 in response to movement of the plunger member 122, as described hereinabove. FIG. 14 shows another example trip assembly 100' having an indication assembly 120'. The indication assembly 120' includes a plunger member 122', the auxiliary switch 140, and an auxiliary switch 130'. The auxiliary switch 130' includes a first electrical contact strip 131' and a second electrical contact strip 132'. The second contact strip 132' is electrically connected to a main printed circuit board 10' (shown in simplified form). The plunger member 122' is substantially the same as the plunger member 122, described hereinabove, except that it is connected to the first contact strip 131'. As a result of this connection, and the fact that the plunger member 122' moves (i.e., due to the crossbar 16 (FIG. 4)), the first contact strip 131' moves between positions.

Figure 15:
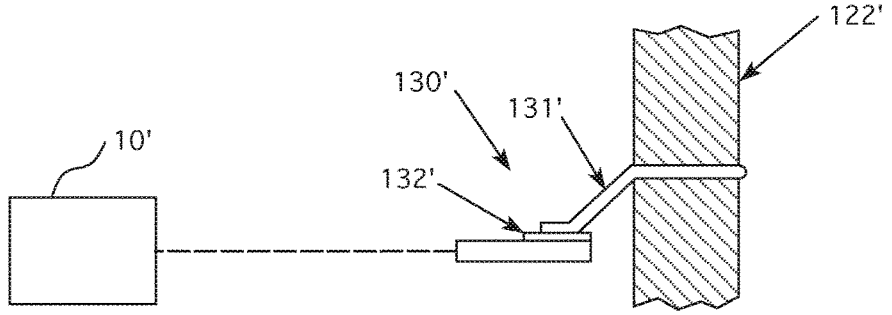
FIG. 15 is an enlarged view of a portion of the trip assembly of FIG. 14.
Figure 16:
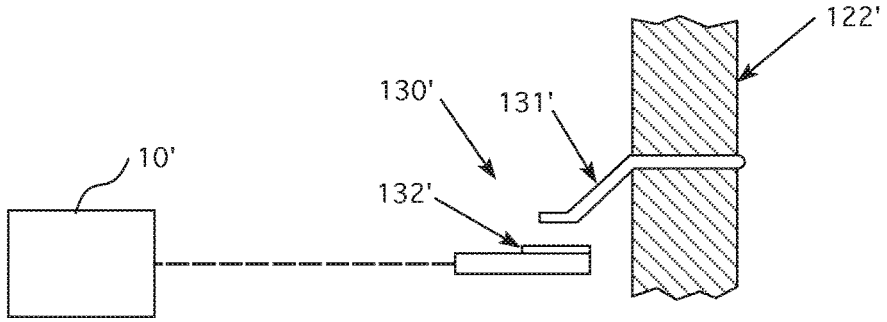
FIG. 16 is another enlarged view of the portion of the trip assembly of FIG. 14, modified to show the contact strips disengaged.

As shown in FIG. 14, and in the enlarged view of FIG. 15, the contact strips 131',132' are engaging each other. However, when the plunger member 122' moves, the first contact strip 131' moves away from the second contact strip 132' and is spaced therefrom. As shown in FIG. 16, the first contact strip 131' is spaced from the second contact strip 132'. The changing of positions between engagement (FIGS. 14 and 15) and disengagement (FIG. 16) of the contact strips 131',132' operates as an auxiliary switch to provide indication to the main printed circuit board 10' of circuit status. In other words, when the plunger member 122' is driven into the auxiliary switch 140 by the crossbar 16, the first contact strip 131' moves away from the second contact strip 132', thereby electrically communicating the circuit status to the main printed circuit board 10'. Additionally, the indication assembly 120' is advantageous in that the auxiliary switch 130' is relatively inexpensive to manufacture/assemble, while still providing a reliable indication of circuit status to the main printed circuit board 10'.

Accordingly, it will be appreciated that the disclosed concept provides for an improved (e.g., without limitation, safer, more efficient in terms of utilization of space, multifunctional) electrical switching apparatus 2 and trip assembly 100 therefor, which among other benefits, utilizes existing space within the circuit breaker 2 to electrically communicate a circuit status to an electrical communication assembly 8, while simultaneously tripping a pair of separable contacts 18.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A trip assembly for an electrical switching apparatus, said electrical switching apparatus comprising a housing, an electrical communication assembly coupled to said housing, separable contacts enclosed by said housing, and an operating mechanism for opening and closing said separable contacts, said trip assembly comprising:

an indication assembly comprising a plunger member and a number of auxiliary switches each structured to be coupled to said housing, wherein said plunger member is structured to actuate each of said number of auxiliary switches, thereby electrically communicating a circuit status to said electrical communication assembly; wherein said plunger member comprises a planar portion and a cylindrical-shaped receiving portion disposed adjacent and perpendicular the planar portion; wherein said indication assembly further comprises a biasing element disposed in the receiving portion; wherein said biasing element engages the planar portion in order to bias said plunger member away from each of said number of auxiliary switches; wherein said trip assembly further comprises a first mounting member and a second mounting member coupled to said first mounting member by a snap-fit mechanism; wherein each of said first mounting member and said second mounting member is structured to be coupled to said housing; and wherein each of said plunger member, said biasing element, and said number of auxiliary switches is contained by each of said first mounting member and said second mounting member.

2. The trip assembly of claim 1 wherein said number of auxiliary switches comprises a first auxiliary switch and a second auxiliary switch each comprising a body portion and a deflection member disposed on said respective body portion; wherein said plunger member is structured to move between said first auxiliary switch and said second auxiliary switch; and wherein, responsive to said plunger member moving between said first auxiliary switch and said second auxiliary switch, each of said deflection member of said first auxiliary switch and said deflection member of said second auxiliary switch deflects inwardly with respect to said respective body portion in order to electrically communicate the circuit status to said electrical communication assembly.

3. The trip assembly of claim 1 wherein said number of auxiliary switches comprises a first auxiliary switch and a second auxiliary switch; wherein said first mounting member comprises a body, a first protrusion extending from said body, and a second protrusion extending from said body; wherein said second mounting member comprises a second body, a third protrusion extending from said second body, and a fourth protrusion extending from said second body; wherein said first auxiliary switch has a first hole and a second hole; wherein said second auxiliary switch has a third hole and a fourth hole; wherein said first protrusion extends into the first hole; wherein said second protrusion extends into the second hole; wherein said third protrusion extends into the third hole; and wherein said fourth protrusion extends into the fourth hole.

4. A trip assembly for an electrical switching apparatus, said electrical switching apparatus comprising a housing, an electrical communication assembly coupled to said housing, separable contacts enclosed by said housing, and an operating mechanism for opening and closing said separable contacts, said trip assembly comprising:

an indication assembly comprising a plunger member and a number of auxiliary switches each structured to be coupled to said housing, wherein said plunger member is structured to actuate each of said number of auxiliary switches, thereby electrically communicating a circuit status to said electrical communication assembly; wherein said trip assembly further comprises a mounting member structured to be coupled to said housing; wherein said number of auxiliary switches comprises a first auxiliary switch and a second auxiliary switch; wherein said first auxiliary switch is coupled to said mounting member; wherein said second auxiliary switch comprises a first contact strip and a second contact strip; wherein said first contact strip is connected to said plunger member; wherein said second contact strip is electrically connected to said electrical communication assembly; wherein said operating mechanism comprises a crossbar; wherein said crossbar is structured to drive said plunger member into said first auxiliary switch; and wherein, when said plunger member is driven into said first auxiliary switch, said first contact strip moves away from said second contact strip, thereby electrically communicating the circuit status to said electrical communication assembly.

5. A trip assembly for an electrical switching apparatus, said electrical switching apparatus comprising a housing, an electrical communication assembly coupled to said housing, separable contacts enclosed by said housing, and an operating mechanism for opening and closing said separable contacts, said trip assembly comprising:

an indication assembly comprising a plunger member and a number of auxiliary switches each structured to be coupled to said housing, wherein said plunger member is structured to actuate each of said number of auxiliary switches, thereby electrically communicating a circuit status to said electrical communication assembly; wherein said electrical switching apparatus further comprises a reset assembly coupled to said housing, wherein said trip assembly further comprises a trip cam structured to cooperate with said reset assembly; and wherein said trip cam comprises a driving leg structured to cooperate with said operating mechanism to trip open said separable contacts.

6. The trip assembly of claim 5 wherein said trip cam further comprises a first recessed retaining portion and a second recessed retaining portion disposed opposite and distal from said first recessed retaining portion; and wherein said driving leg extends from said first recessed retaining portion.

7. The trip assembly of claim 6 wherein said trip cam further comprises a reset leg and a transfer leg; wherein said reset leg extends from said second recessed retaining portion; wherein said transfer leg is disposed between said reset leg and said driving leg; and wherein said transfer leg is spaced from each of said first recessed retaining portion and said second recessed retaining portion.

8. An electrical switching apparatus comprising:

a housing;

an electrical communication assembly coupled to said housing;

separable contacts enclosed by the housing;

an operating mechanism for opening and closing said separable contacts; and a trip assembly comprising:

an indication assembly comprising a plunger member and a number of auxiliary switches each coupled to said housing, wherein said plunger member is structured to actuate each of said number of auxiliary switches, thereby electrically communicating a circuit status to said electrical communication assembly; wherein said electrical switching apparatus further comprises a reset assembly coupled to said housing, wherein said trip assembly further comprises a trip cam structured to cooperate with said reset assembly; and wherein said trip cam comprises a driving leg structured to cooperate with said operating mechanism to trip open said separable contacts.

9. The electrical switching apparatus of claim 8 wherein said number of auxiliary switches comprises a first auxiliary switch and a second auxiliary switch each comprising a body portion and a deflection member disposed on said respective body portion; wherein said plunger member is structured to move between said first auxiliary switch and said second auxiliary switch; and wherein, responsive to said plunger member moving between said first auxiliary switch and said second auxiliary switch, each of said deflection member of said first auxiliary switch and said deflection member of said second auxiliary switch deflects inwardly with respect to said respective body portion in order to electrically communicate the circuit status to said electrical communication assembly.

10. The electrical switching apparatus of claim 8 wherein said plunger member comprises a planar portion and a cylindrical-shaped receiving portion disposed adjacent and perpendicular the planar portion; wherein said indication assembly further comprises a biasing element disposed in the receiving portion; and wherein said biasing element engages the planar portion in order to bias said plunger member away from each of said number of auxiliary switches.

11. The electrical switching apparatus of claim 10 wherein said trip assembly further comprises a first mounting member and a second mounting member coupled to said first mounting member by a snap-fit mechanism; wherein each of said first mounting member and said second mounting member is coupled to said housing; and wherein each of said plunger member, said biasing element, and said number of auxiliary switches is contained by each of said first mounting member and said second mounting member.

12. The electrical switching apparatus of claim 11 wherein said number of auxiliary switches comprises a first auxiliary switch and a second auxiliary switch; wherein said first mounting member comprises a body, a first protrusion extending from said body, and a second protrusion extending from said body; wherein said second mounting member comprises a second body, a third protrusion extending from said second body, and a fourth protrusion extending from said second body; wherein said first auxiliary switch has a first hole and a second hole; wherein said second auxiliary switch has a third hole and a fourth hole; wherein said first protrusion extends into the first hole; wherein said second protrusion extends into the second hole; wherein said third protrusion extends into the third hole; and wherein said fourth protrusion extends into the fourth hole.

13. The electrical switching apparatus of claim 8 wherein said trip assembly further comprises a mounting member coupled to said housing; wherein said number of auxiliary switches comprises a first auxiliary switch and a second auxiliary switch; wherein said first auxiliary switch is coupled to said mounting member; wherein said second auxiliary switch comprises a first contact strip and a second contact strip; wherein said first contact strip is connected to said plunger member; wherein said second contact strip is electrically connected to said electrical communication assembly; wherein said operating mechanism comprises a crossbar; wherein said crossbar is structured to drive said plunger member into said first auxiliary switch; and wherein, when said plunger member is driven into said first auxiliary switch, said first contact strip moves away from said second contact strip, thereby electrically communicating the circuit status to said electrical communication assembly.

14. The electrical switching apparatus of claim 8 wherein said trip cam further comprises a first recessed retaining portion and a second recessed retaining portion disposed opposite and distal from said first recessed retaining portion; and wherein said driving leg extends from said first recessed retaining portion.

15. The electrical switching apparatus of claim 14 wherein said trip cam further comprises a reset leg and a transfer leg; wherein said reset leg extends from said second recessed retaining portion; wherein said transfer leg is disposed between said reset leg and said driving leg; and wherein said transfer leg is spaced from each of said first recessed retaining portion and said second recessed retaining portion.

16. A trip assembly for an electrical switching apparatus, said electrical switching apparatus comprising a housing, an electrical communication assembly coupled to said housing, separable contacts enclosed by said housing, and an operating mechanism for opening and closing said separable contacts, said trip assembly comprising:

an indication assembly comprising a plunger member and a number of auxiliary switches each structured to be coupled to said housing, wherein said plunger member is structured to actuate each of said number of auxiliary switches, thereby electrically communicating a circuit status to said electrical communication assembly; wherein said trip assembly further comprises a first mounting member and a second mounting member coupled to said first mounting member by a snap-fit mechanism; wherein each of said first mounting member and said second mounting member is structured to be coupled to said housing; and wherein each of said plunger member and said number of auxiliary switches is contained by each of said first mounting member and said second mounting member.

* * * * *